US009702278B2

(12) United States Patent
Gruener et al.

(10) Patent No.: US 9,702,278 B2
(45) Date of Patent: Jul. 11, 2017

(54) ELECTROMAGNETIC ACTUATING APPARATUS AND SYSTEM FOR ADJUSTING A FUNCTIONALITY OF A MOTOR VEHICLE ASSEMBLY

(71) Applicant: ETO Magnetic GmbH, Stockach (DE)

(72) Inventors: Maria Gruener, Owingen-Billafingen (DE); Timo Rigling, Moos (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/902,602

(22) PCT Filed: May 16, 2014

(86) PCT No.: PCT/EP2014/060094
§ 371 (c)(1),
(2) Date: Jan. 4, 2016

(87) PCT Pub. No.: WO2015/010803
PCT Pub. Date: Jan. 29, 2015

(65) Prior Publication Data

US 2016/0186622 A1 Jun. 30, 2016

(30) Foreign Application Priority Data

Jul. 26, 2013 (DE) ..... 10 2013 108 027

(51) Int. Cl.
*F01L 1/34* (2006.01)
*F01L 9/04* (2006.01)
(Continued)

(52) U.S. Cl.
CPC *F01L 9/04* (2013.01); *F01L 1/14* (2013.01); *F01L 13/0036* (2013.01);
(Continued)

(58) Field of Classification Search
CPC ..... F01L 9/04; F01L 1/14; F01L 2009/0425; F01L 13/0036; H01F 7/1646
(Continued)

(56) References Cited

U.S. PATENT DOCUMENTS 8,474,421 B2 * 7/2013 Gregor ..... F01L 13/0036 123/90.11
8,939,119 B2 1/2015 Werner et al.
9,074,496 B2 7/2015 Schuler

FOREIGN PATENT DOCUMENTS

DE 102009009081 8/2010
DE 102009015486 9/2010
(Continued)

OTHER PUBLICATIONS

International Apln. No. PCT/2014/060094 search report dated Oct. 29, 2014.
(Continued)

*Primary Examiner* — Zelalem Eshete
(74) *Attorney, Agent, or Firm* — Bachman & LaPointe, PC

(57) ABSTRACT

An electromagnetic actuating apparatus with two armature means which are designed to exert an actuating force on two tappet units which are extended in the longitudinal direction along a longitudinal movement axis and are guided such that they can be moved in a parallel manner in a common guide section of a housing which accommodates the armature means, wherein the tappet units each have an engagement end which is designed to interact with an actuating groove in a motor vehicle motor adjustment system and projects from the guide section at least in an engaged state, and the common guide section forms a guide end surface in which guide openings associated with the two tappet units, are open, wherein a connecting path which runs through center axes of the only two guide openings in the guide end surface
(Continued)

forms an offset (v) from a surface center point of the guide end surface and/or from a surface center point of a housing end surface of the housing, wherein the surface center point lies on a perpendicular bisector of the connecting path.

15 Claims, 2 Drawing Sheets

(51) Int. Cl.

| | |
|---|---|
| ***F01L 13/00*** | (2006.01) |
| ***H01F 7/16*** | (2006.01) |
| ***F01L 1/14*** | (2006.01) |

(52) U.S. Cl.
CPC .... *H01F 7/1646* (2013.01); *F01L 2009/0425* (2013.01); *F01L 2013/0052* (2013.01); *F01L 2820/031* (2013.01)

(58) Field of Classification Search
USPC ..... 123/90.16
See application file for complete search history.

(56) References Cited

FOREIGN PATENT DOCUMENTS

| | | |
|---|---|---|
| DE | 10 2011 003 760 | 5/2012 |
| DE | 10 2011 050 730 | 12/2012 |
| DE | 20 2012 104 122 | 3/2013 |
| WO | 2008115119 | 12/2008 |
| WO | 2012163591 | 6/2012 |

OTHER PUBLICATIONS

German Patent Apln. No. 10 2013 108 027.8 Office action dated Mar. 23, 2014.

* cited by examiner

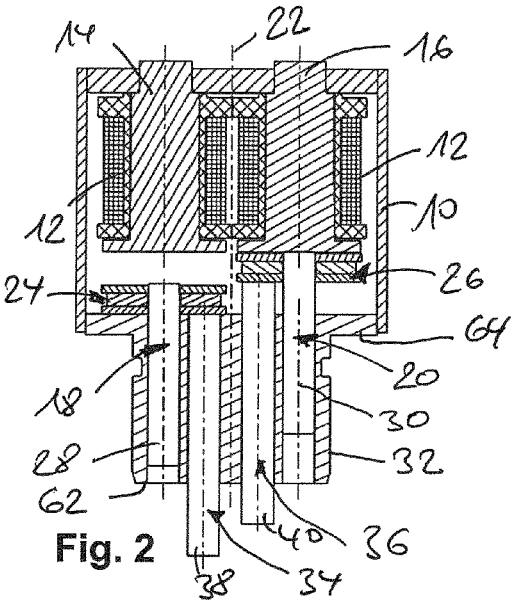
Fig. 2
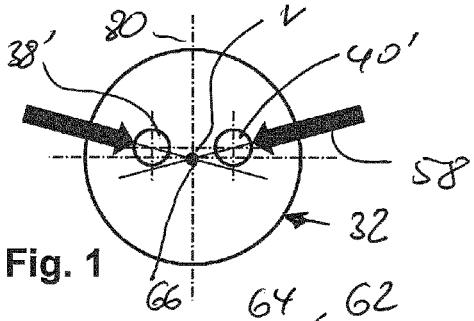
Fig. 1
Fig. 3
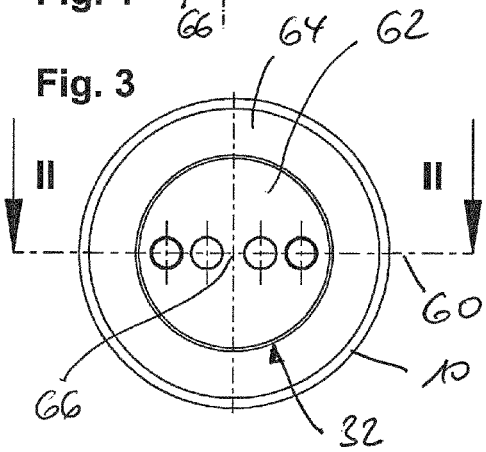
Fig. 4
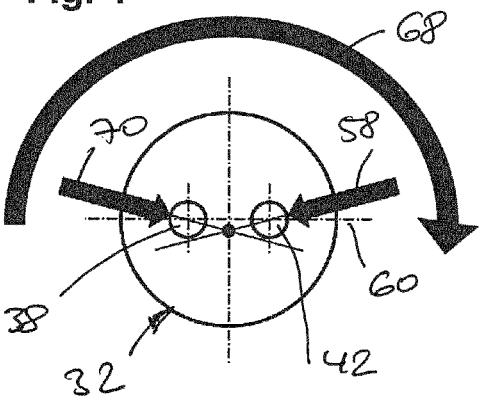
Fig. 8
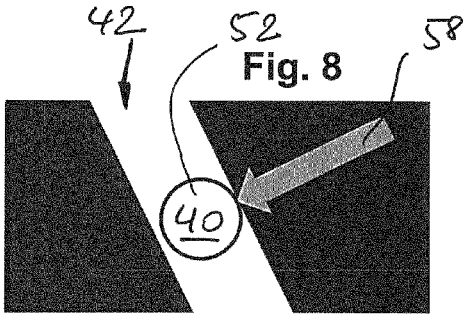
Fig. 5
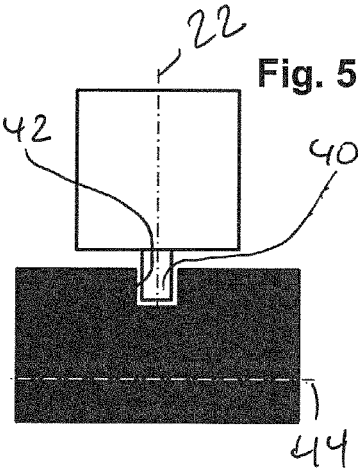
Fig. 6
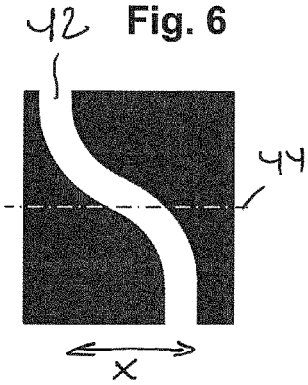
Fig. 7
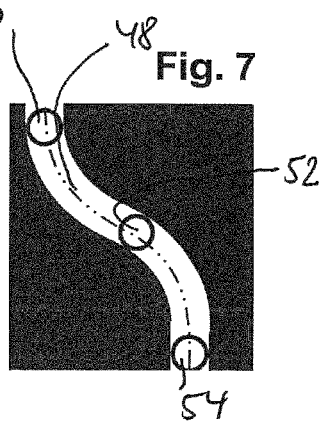

ELECTROMAGNETIC ACTUATING APPARATUS AND SYSTEM FOR ADJUSTING A FUNCTIONALITY OF A MOTOR VEHICLE ASSEMBLY

BACKGROUND OF THE INVENTION

The present invention relates to an electromagnetic actuating apparatus as is known from DE 10 2011 050 730 A1 or DE 10 2011 003 760 A1. The present invention further relates to a system for adjusting a functionality of a motor vehicle assembly providing an adjustment groove using such an electromagnetic actuating apparatus.

SUMMARY OF THE INVENTION

Electromagnetic actuating apparatuses are known from the prior art, which are used in particular and advantageously as camshaft adjustment apparatuses for an internal combustion engine. Such an apparatus, assumed as being generic, is disclosed by the applicant's WO 2008/155119 A1, in which the electromagnetic actuating apparatus in the form of a multiple actuator has a plurality of tappet devices, guided parallel to one another, driven by respectively associated armature units, which tappet devices can come into engagement, according to a respective actuating position, with an adjustment groove of the camshaft adjustment. An armature unit associated with a respective one of the tappet units has here advantageously a carrier section (formed, for instance of a cylindrical, having a planar surface for interaction with an armature-side end of the tappet unit opposed to the engagement end) and an elongated guide tappet, which is guided in an axially movable manner in a stationary core of a respective armature unit (armature means). Such actuators are advantageous both with regard to their operating characteristics and also concerning a cost-efficient manufacture suitable for mass production and—also beyond the described and preferred usage context of camshaft adjustment—have proved to be successful and have established themselves for a variety of actuating applications.

FIGS. 2 and 3 illustrate the initial situation for the present invention in the form of a further development of the technology known from WO 2008/155119, wherein FIG. 2 shows a double actuator, accommodated in a (here cylindrical) housing 10, in the form of a pair of stationary core elements 14, 16 surrounded respectively by coil units 12, with respect to which respectively armature units 18 or respectively 20 are able to be driven movably parallel to a housing centre axis 22. In an otherwise known manner, this drive takes place by a repelling force, generated by means of the coil units 12 on respective activation, onto carrier sections 24 or respectively 26 of the respective armature units 18 or respectively 20, wherein these carrier sections have axially magnetized permanent magnetic discs; for further explanation, reference is also to be made in this respect to the previously published WO 2008/155119. Elongate tappet-like armature guide sections 28 or respectively 30, sitting on the carrier sections 24 or respectively 26, are guided in an axially movable manner in a housing guide section and make it possible that the carriers 24 or respectively 26, which are widened with respect to the guide sections 28, 30, can guide out from the guide housing section 32 tappet units 34 or respectively 36 which are sitting there respectively eccentrically and adhering magnetically. At the end side, the engagement ends 38 or respectively 40 of the tappets 34, 36 then enter in a moved-out engagement state (respectively to be activated) into engagement with an associated control groove of the camshaft adjustment and thus bring about in an otherwise known manner the adjustment of the engine functionality, by the adjustment groove, with tappet end engaging therein, forcing an axial movement of an associated cam adjustment shaft.

For further explanation of the backgrounds and the problems resulting therefrom, reference is made furthermore to the diagrammatic illustrations of FIGS. 4 to 8, wherein firstly in a first diagrammatic representation, FIG. 5 illustrates how an electromagnetic actuating apparatus (shown only diagrammatically), constructed in practical terms for instance in the configuration of FIG. 2, 3, engages with an engagement end 40 of a tappet in the extended state into an actuating groove 42 of a shaft, provided for adjustment, rotating about its own adjustment axis 44. The developments of FIG. 6 or respectively 7 show that the groove 42 does not run approximately radially around the circumference of this shaft, but rather has an axial offset X, as shown in FIG. 6. The shaft is therefore displaceable by this axial stroke by the engaging of the tappet end 38, namely in that the electromagnetic actuating apparatus (typically mounted in a stationary and immovable manner in the engine compartment or respectively on the internal combustion engine) with its tappet 36, shown by way of example (or respectively with the associated engagement end 40) in the engagement state travels the path shown in FIG. 7 (double-dot and dashed line 48) and makes provision that the tappet (accordingly immovable along the adjustment axis 44) with its tappet end, by the engaging into the groove, brings about the adjustment along the stroke x in FIG. 6. In practical terms, FIG. 7 shows, for illustration, three positions of this engaging tappet, designated by the reference number 50 (for the start of engaging), 52 (for a point in the engagement- and movement sequence, at which significant forces are transmitted through the tappet end into the groove 42 and thereby to the shaft), and 54, which in this respect marks an end point of the movement, at which typically (through suitable groove configuration, for instance lifting of the groove base, the tappet is returned from its extended position into an inserted position, for instance into the position of the tappet 36 on the right-hand side of FIG. 2).

FIG. 8 illustrates by the grey arrow 58 a problem arising through this adjustment behaviour of the tappet, in particular concerning a resulting torque on the housing section 32 and consequently the connection of the housing section 32 to the surrounding housing 10; for further explanation, the arrow diagrams of FIG. 4 are referred to: Through the fact that according to the example embodiment which is shown, a pair of tappet units (34 or respectively 36 in FIG. 2, FIG. 3), which in the face-side views of FIG. 3 or respectively FIG. 4 are connected by a symmetry axis 60 as area bisector (both of an end surface 62 of the housing section 32 and also of a surrounding end surface 64 of the housing 10), the discussed application of force, visually represented as arrow 58, generates a torque onto the housing section 32 relative to the surrounding housing 10. FIG. 4 illustrates the associated geometry: Through the fact that according to arrow direction 58 along the wall of the groove 42 in the engaged date 52 the application of force via the engagement end to the housing section does not take place purely radially (in relation to a surface centre point 66, which in the described example of FIG. 2, 3 is likewise surface centre point and surface centre of gravity both for the front guide end surface 62 and also for the housing end surface 64), a torque occurs, which is visually represented by the rotary arrow 68 in FIG. 4. Geometrically, this is due to the fact that—cf. the illustration of FIG. 4, in which in addition a force vector 70 is shown, produced for an engagement state for instance on a resetting in the groove 42 by the tappet 34—, the force vectors meet according to their extension outside the centre point 66, consequently a transverse lever is present.

In the mechanical consequence, the torque illustrated by the illustration 68 then leads to a mechanical connection between the housing guide section 32 (here with a ring flange sitting in one piece, forming the housing end surface 64) and the hollow cylindrical housing 10 being stressed, which connection is typically realized via a press fit or suchlike connection. As in a motor vehicle operating context in any case vibrations, thermal influences and further forces act on this critical housing transition, the stress is additionally intensified through the mechanism described in the introduction with regard to the prior art.

Against the background that during an entire duration of use of such a camshaft adjustment apparatus (therefore practically during an entire engine lifespan) the connection between the housing section 32 and the housing 10 must remain stable, furthermore provision must be made for fluid-tightness of the apparatus and against the background that typically in a motor vehicle engine installation context the available installation space for mechanical reinforcements or stiffeners is limited, the technical problem arises of minimizing a stress of this critical connection transition between the housing sections 10, 32.

Accordingly, it is therefore an object of the present invention to further develop a generic electromagnetic actuating apparatus so that a potentially disadvantageous transverse force produced during the tappet engagement into an actuating partner (for instance into the adjustment groove, shown by way of example) onto the tappet and the associated housing guide section leads to no or at least to a minimized impairment of the housing connection between the housing guide section and the housing accommodating the armature units. Here, the basic teaching of an offset of a guide opening of a tappet unit with respect to a line running through a surface centre point of the housing is to be assumed as being known.

The problem is solved by the electromagnetic actuating apparatus having the features disclosed herein and the system for adjusting a functionality of a motor vehicle assembly providing an adjustment groove as disclosed herein; advantageous further developments of the invention are also described herein, wherein in particular the further developments of the actuating apparatus are to be regarded as disclosed in a manner belonging to the invention.

In an advantageous manner according to the invention, departing from the prior art which is drawn upon according to WO 2008/155119 (or respectively according to the illustration in FIGS. 2 to 8), an offset is provided as a segment or respectively distance in the end surface(s), by which the at least two guide openings (guide bores) for the guiding out of the tappet units (or respectively the engagement ends thereof) are offset (distanced) from the associated surface centre point. This means that, for instance proceeding from the example of FIG. 4, the arrangement of the tappet ends (or respectively of the associated apertures) in the end surface is no longer symmetrical for the two surface axes, rather the tappet guides are displaced out from at least one axis centre in the end surface by the offset or respectively are arranged spaced apart from the centre point. Ideally, this offset in accordance with an angle of attack, which is advantageously to be adopted, of the lateral force vector (brought about by the groove in engagement) onto the respective tappet end is dimensioned in the range between 5 and 40°, preferably between 10 and 30°, and further preferably between 10 and 20°, so that in this way then the force vector runs through the (respective) surface centre, i.e. the respective surface centre point or respectively surface centre of gravity and thus with this lateral application of force no mechanically disadvantageous torque acts any more on the housing guide section (relative to the armature housing section). Consequently, the advantage is achieved that even in a long-term operation over many years with a plurality of groove engagements, no additional stressing of this critical connection point occurs.

In a manner which is structurally preferred and is favourable according to a further development, it has proved to be of value here to arrange the guide openings (guide bores) for the two tappet units in the end surface so that geometrically the imaginary connecting path between these guide openings (more precisely: between the axial centre points of these respective openings) is arranged to the surface centre point so that the perpendicular bisector through the connecting path runs through the surface centre point.

Whereas within the scope of practical realizations of the invention usually the guide end surface (i.e. the end surface of the guide housing section) lies centre-symmetrically within the housing end surface and accordingly the surface centre points for both surfaces coincide, nevertheless configurations are conceivable, in which these diverge; here, it would then be provided that the offset according to the invention in this respect is effective for the housing end surface, in order to neutralize the disadvantageous torque load of the housing connection between the (armature) housing and the housing guide section.

Accordingly, it is possible according to a further development and is included by the invention, to provide almost any desired end surface configurations in particular of the guide section, wherein, however, point-symmetrical or axially symmetrical circumferential contours are preferred according to further development. Likewise, it is basically conceivable to also configure the end face geometry of the (armature) housing in any desired manner (as long as the torque application of the housing connection can occur), nevertheless cylindrical housing shapes and consequently a circular end contour are preferred here.

According to a further development within the scope of the invention, a dimensioning- or respectively construction specification is provided for the offset according to the invention. On the one hand, it is preferred to describe this offset by the geometric relationship offset $v=b\times\tan\alpha$, where b corresponds to half of the connecting path between the guide openings (more precisely: the centre points thereof). It is preferred according to the invention, in the case of typical groove geometries, to set the angle $\alpha$ to an angle between 5° and 40°, further preferably to a range between 10° and 30°; still further preferably to a range between approximately 10° and 15°.

Alternatively, the dimensioning for the offset v can take place by the dimensioning specification being $v=a\times\sin\alpha$, where a is the segment measurement (distance) of a centre axis of a respective guide opening in the end surface to a surface centre point; in so far as the surface centre point of the guide end surface does not in any case coincide with the surface centre point of the housing end surface, it is preferred to select here the surface centre point of the housing end surface.

According to a further development and within the scope of a preferred form of realization of the invention, provision is to be made to couple a respective one of the tappet units detachably with the armature means, further preferably by the provision, according to further development, of the carrier sections. In this way, for instance, a respective tappet unit can rotate relative to the armature unit, so that also in this respect a torque absorption (potentially harmful to service life or respectively lifespan) is prevented. The (correspondingly detachable) sitting of the tappet unit on the armature-side end in a permanently magnetic manner (namely by means of the permanent magnet means present advantageously on the armature side in any case for drive purposes) is again advantageous in a further developing manner, so that favourable (detachable) adhesion effect is combined with rotatability of a respective tappet, whereby a good technical compromise was able to be found between mechanical uncoupling on the one hand (for the purpose of reducing a mechanical stress of the tappet armature unit) and an adhesion and a force transfer on the other hand between armature and tappet.

Advantageously again according to a further development, provision is made to configure at least one of the tappet units at its engagement end by targeted material influencing or material selection, so that this has the best possible hardness- or wear characteristics for interaction with the provided actuating partner (i.e. typically the actuating groove in the camshaft adjustment unit). The tappet, typically realized from a metal material, can be configured for this purpose for instance in this engagement region in a particular manner so as to be wear-resistant, for instance by a (local) hardening at the engagement end, additionally or alternatively it is possible to configure the elongated tappet unit along its extent direction with a plurality of different material sections (typically connected securely and non-detachably with one another) so that a desired increased wear resistance is realized through materials which are correspondingly hard and optimized for this purpose. Merely by way of example, nevertheless for the realization of such a further development, the subject of the applicant's DE 20 2012 104 122, in particular with regard to the configuration of the engagement end of the tappet unit, the associated production methods and material parameters, is considered as belonging to the invention included in the present application.

The system claimed according to the invention places the electromagnetic actuating apparatus according to the invention in relation to the motor vehicle assembly in practical terms in that the electromagnetic actuating apparatus according to the main claim is claimed in interaction with the axially displaceably mounted adjustment axis, having an adjustment groove. Advantageously, this is positioned relative to the actuating apparatus for actuation by engagement with the engagement end so that a force vector, applied in an engagement state from the adjustment groove to the engagement end, extends (in the projection) through the surface centre point of the housing end surface, in other words, the groove geometry with the angle specification thereby provided for the force vector and/or a distance between two adjacent tappet units in the end surface is arranged so that according to the invention no torque acts on the housing guide section.

In further development, it is advantageous for this to align the housing with a central centre axis (which then typically runs through the surface centre point of the housing end surface) to the adjustment axis so that the respective centre axes intersect orthogonally.

As a result, the present invention achieves a significant mechanical improvement to the generic technology, in such a way that through uniform transferring of at least one of the tappet units from the end surface(s) along at least one axis dimension, at significant torque reduction (to the point of a torque neutralization) can be achieved of a torque acting through the control groove laterally onto the tappet concerned and hence onto the housing connection between housing guide section and (surrounding) armature housing.

BRIEF DESCRIPTION OF THE DRAWINGS

Further advantages, features and details of the invention will emerge from the following description of preferred example embodiments and said drawings; these show in FIG. 1 a diagrammatic representation to illustrate the procedure according to the invention in the arranging of guide openings (guide bores) in the guide end surface, here in the case of a pair of tappet units guided parallel to one another;

FIG. 2 a longitudinal sectional view through a double actuator device for camshaft adjustment by means of a pair of tappet units (as in-house unpublished prior art at the time of application);

FIG. 3 a face-side view onto the central guide end surface, and the housing end surface surrounding the latter, of the example embodiment of FIG. 2 (wherein in this respect II-II indicates the section line for the longitudinal sectional view of FIG. 2);

FIG. 4 a geometrical representation to illustrate the occurrence of a torque action on the housing connection in the example embodiment of FIG. 2 on application of force along the force vector 58;

FIG. 5-8 diagrammatic individual representations to illustrate the lateral forces occurring on an engagement of an engagement end of a tappet unit into an actuating groove and FIG. 9 a detail representation from the face-side view of FIG. 1 (more precisely: of the upper right-hand quadrant) to illustrate details of the dimensioning according to the invention, in particular to illustrate the respective distances, angles and their relationships to one another.

DETAILED DESCRIPTION

Figure 9:
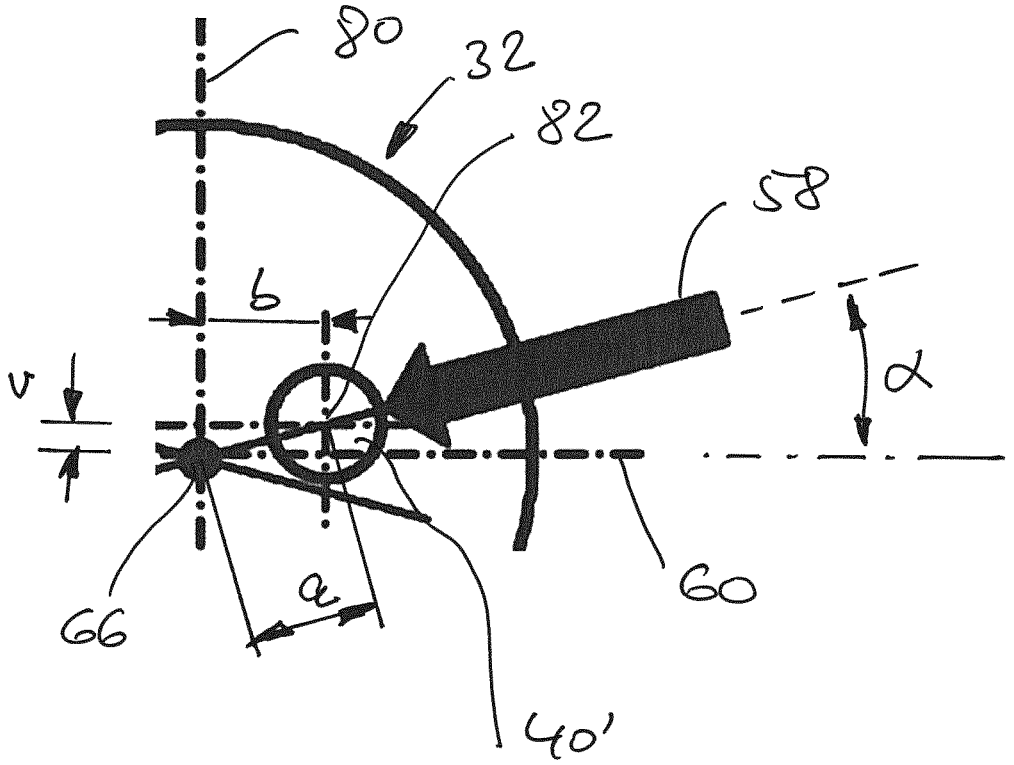

FIG. 1 shows diagrammatically and in an analogous manner to the illustration regarding the (self-selected) prior art according to FIG. 4, the realization of the invention in the practical example embodiment of the double actuator, as was described with structural details in FIGS. 2 and 3. In so far as not discussed differently below, the details for execution shown in the figures apply likewise, wherein in particular, taking into consideration the offset v, to be discussed in detail below, the form of realization of FIG. 1 or respectively FIG. 9, can be realized as an example embodiment of the invention with recourse to the structural elements of FIG. 2, 3.

In practical terms, the illustration of FIG. 1 shows how engagement ends 38' or respectively 40' are displaced by an offset v along a symmetry axis 80 from the surface centre point 66, so that the lateral force vector 58, produced by the engaging into the groove 42 (in this respect analogous to FIGS. 5 to 8) now runs through this centre point 66, correspondingly through this force (in the absence of a lever arm) a torque is no longer brought to the housing 32.

The detail enlargement of FIG. 9 illustrates how this offset v can be dimensioned: Between the axes 80 or respectively 60, standing orthogonally to one another, spanning the end surface 62, v describes as offset the extent by which a bore centre point 82 of the bore associated with the tappet unit 36 (or respectively with the associated engagement end 40), is distant, along the axis 80, from the axis 60. To complete a right-angled triangle, b describes the half of the distance between the pair of tappet units in the end surface (more precisely: the distance between the respective centre points), and the measurement a describes as hypotenuse the distance between the centre point 66 and the centre point 82.

In the illustrated example embodiment, an angle of the force vector of $\alpha=15°$ is provided through the groove course of the groove 42 in the critical region, so that in the realization or respectively dimensioning of the electromagnetic actuating apparatus, the offset v can be arranged in one of the following two ways:

$$v=a\times\sin\alpha \quad (1)$$

$$v=b\times\tan\alpha, \quad (2)$$

wherein the specialist in the art will select the dimensioning which corresponds to a respective specification or respectively is provided through geometrical installation conditions. Typically, interest exists for instance in an installation location on the motor vehicle engine, in order to keep as small as possible a distance between the adjacent tappets (and hence the measurement b).

The present invention is not restricted to the example embodiment which is shown. Rather, any desired other configurations, also concerning the precise configuration of respectively associated armature units, their arrangement in the housing or suchlike can be configured and varied according to a respective case of application, with this applying for instance also to other configurations of the housing—for example the housing 32 can be embodied having several parts.

Finally, the present invention is indeed particularly favourably suited for the usage context for the adjustment of an engine functionality of an internal combustion engine, however the invention is not limited to this purpose of use, but rather it is basically possible, and included by the invention, to also make other fields of application accessible to this optimized technology.

The invention claimed is:

1. An electromagnetic actuating apparatus with two armature means (24, 26, 18, 20) which are designed to exert an actuating force on two tappet units (34, 36) which are extended in the longitudinal direction along a longitudinal movement axis and are guided such that they can be moved in a parallel manner in a common guide section (32) of a housing which accommodates the armature means, wherein the tappet units each have an engagement end (38, 40) which is designed to interact with an actuating groove in a motor vehicle motor adjustment system and projects from the guide section at least in an engaged state, and the common guide section forms a guide end surface (62) in which guide openings associated with the two tappet units, are open, wherein a connecting path (2*b*) which runs through centre axes of the only two guide openings in the guide end surface forms an offset (v) from a surface centre point (66) of the guide end surface and/or from a surface centre point (66) of a housing end surface of the housing, wherein the surface centre point lies on a perpendicular bisector (80) of the connecting path (2*b*).

2. The apparatus according to claim 1, wherein the perpendicular bisector of the connecting path forms a symmetry axis for the guide end surface and/or the housing end surface.

3. The apparatus according to claim 1, wherein the guide end surface forms a circular, oval, rectangular or polygonal circumferential contour or in circumference describes hybrid forms thereof.

4. The apparatus according to claim 1, wherein the offset is arranged so that the relationship:

$$\text{offset } v=b\cdot\tan\alpha$$

applies, wherein b corresponds to half the measurement of the connecting path and $\alpha$ corresponds to an angle between 5° and 40°.

5. The apparatus according to claim 4, wherein $\alpha$ corresponds to an angle between 10° and 30°.

6. The apparatus according to claim 1, wherein the offset is arranged so that the relationship:

$$\text{offset } v=a\cdot\sin\alpha$$

applies, wherein a corresponds to the distance of a centre axis of one of the guide openings in the guide- and/or housing end surface from a respective surface centre point (66) and $\alpha$ corresponds to an angle between 5° and 40°.

7. The apparatus according to claim 6, wherein $\alpha$ corresponds to an angle between 10° and 30°.

8. The apparatus according to claim 1, wherein the guide section (32) is connected on or in an armature housing (10) which is widened in at least a transverse direction with respect to the guide end surface.

9. The apparatus according to claim 8, wherein the guide section (32) is connected on or in the armature housing in a torque-proof manner.

10. The apparatus according to claim 1, wherein at least one of the tappet units (34, 36) in the region of the engagement end (38, 40) is realized from a material having an increased wear resistance.

11. The apparatus according to claim 1, wherein the armature means provide a carrier section (24, 26) constructed for the detachable sitting of an associated one of the tappet units with an end lying opposite the engagement end.

12. The apparatus according to claim 1, wherein at least one of the tappet units is guided rotatably in the guide section (32) and/or the tappet units (34, 36) are guided parallel to one another.

13. A system for adjusting a functionality of a motor vehicle assembly providing an adjustment groove (42), with an electromagnetic actuating apparatus with a plurality of armature means (24, 26, 18, 20) which are designed to exert an actuating force on a plurality of tappet units (34, 36) which are extended in the longitudinal direction along a longitudinal movement axis and are guided such that they can be moved adjacent to one another in a common guide section (32) of a housing which accommodates the armature means, wherein the tappet units each have an engagement end (38, 40) which is designed to interact with an actuating groove in a motor vehicle motor adjustment system and projects from the guide section at least in an engaged state, and the common guide section forms a guide end surface (62) in which guide openings, in particular guide bores, associated with the plurality of tappet units, are open, and wherein a connecting path (2*b*) which runs through centre axes of two guide openings in the guide end surface forms an offset (v) from a surface centre point (66) of the guide end surface and/or from a surface centre point (66) of a housing end surface of the housing, and with an axially displaceably mounted adjustment axis, having the adjustment groove (42), which is positioned for actuation by engagement with the engagement end (40) relative to the electromagnetic actuating apparatus so that the projection of the force vector (58) to the end surface of a force applied in an engagement state from the adjustment groove to the engagement end extends through the surface centre point of the housing end surface.

14. The system according to claim 13, wherein the guide openings are guide bores.

15. The system according to claim 13, wherein the electromagnetic actuating apparatus is aligned relative to the adjustment axis so that the adjustment axis (44) extends orthogonally to a centre axis (22) of the actuating apparatus extending through the surface centre point (66) of the housing end surface and parallel to the longitudinal movement axis and can be moved axially in the engagement state.

* * * * *